US011460218B2

(12) United States Patent
Liu et al.

(10) Patent No.: US 11,460,218 B2
(45) Date of Patent: Oct. 4, 2022

(54) PANEL DRIVING ASSEMBLY AND AIR CONDITIONER HAVING THE SAME

(71) Applicant: GREE ELECTRIC APPLIANCES, INC. OF ZHUHAI, Guangdong (CN)

(72) Inventors: Han Liu, Guangdong (CN); Xu Gao, Guangdong (CN); Zhiqiang Gao, Guangdong (CN); Shi Cheng, Guangdong (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 1212 days.

(21) Appl. No.: 15/767,643

(22) PCT Filed: Sep. 18, 2016

(86) PCT No.: PCT/CN2016/099246
§ 371 (c)(1),
(2) Date: Apr. 11, 2018

(87) PCT Pub. No.: WO2017/067357
PCT Pub. Date: Apr. 27, 2017

(65) Prior Publication Data

US 2018/0306461 A1 Oct. 25, 2018

(30) Foreign Application Priority Data

Oct. 21, 2015 (CN) ..... 201510698218.3

(51) Int. Cl.
*F24F 13/14* (2006.01)
*F24F 13/20* (2006.01)
*F24F 1/0007* (2019.01)

(52) U.S. Cl.
CPC ..... *F24F 13/1426* (2013.01); *F24F 1/0007* (2013.01); *F24F 13/20* (2013.01); *F24F 2013/1446* (2013.01)

(58) Field of Classification Search
CPC ..... F24F 13/1426; F24F 1/0007; F24F 13/20; F24F 2013/1446; F16H 2057/087;
(Continued)

(56) References Cited

U.S. PATENT DOCUMENTS 5,782,688 A * 7/1998 Baek ..... F24F 1/0011 454/324
5,810,658 A * 9/1998 Seo ..... F24F 13/06 454/324
6,247,242 B1 * 6/2001 Sujino ..... G01D 5/04 33/709

FOREIGN PATENT DOCUMENTS

CN 202145042 U 2/2012
CN 203797898 U 8/2014
(Continued)

OTHER PUBLICATIONS

Nagoshi, Kenji, JP2011122731 Translation.pdf, "Air conditioner", Jun. 2011, pp. 1-11.*
(Continued)

*Primary Examiner* — Avinash A Savani
*Assistant Examiner* — Ryan L Faulkner
(74) *Attorney, Agent, or Firm* — Li & Cai Intellectual Property (USA) Office

(57) ABSTRACT

Provided are a panel driving assembly and an air conditioner having the same. The panel driving assembly is used for driving a panel part (10), and the panel driving assembly includes: a first connecting piece (20), is provided with a first rack (21), a first end of the first connecting piece (20) is movably connected with the panel part (10); and a driving part (30), a first end of the driving part (30) is movably connected with the panel part (10), a second end of the driving part (30) is engaged with the first rack (21), and the driving part (30) driving the panel part (10) to be opened or closed. The panel driving assembly effectively solves a
(Continued)

problem of high heat exchange efficiency loss of an air conditioner in the prior art.

13 Claims, 4 Drawing Sheets

(58) Field of Classification Search
CPC ..... F16H 19/04; F16H 21/14; F16H 37/12; F16H 55/26
USPC ..... 454/236
See application file for complete search history.

(56) References Cited

FOREIGN PATENT DOCUMENTS

| | | | |
|---|---|---|---|
| CN | 104121628 | A | 10/2014 |
| CN | 104279625 | A | 1/2015 |
| CN | 204494743 | U | 7/2015 |
| CN | 105180399 | A | 12/2015 |
| CN | 205090577 | U | 3/2016 |
| EP | 1950501 | A1 | 7/2008 |
| EP | 2759780 | A1 | 7/2014 |
| JP | 2007170788 | A | 7/2007 |
| JP | 2009063261 | A | 3/2009 |
| JP | 2011122731 | A | 6/2011 |
| KR | 0156706 | B1 | 1/1999 |
| WO | WO 2011021338 | A1 | 2/2011 |

OTHER PUBLICATIONS

WIPO, International Search Report dated Dec. 8, 2016.
European Patent Office, Supplementary European Search Report dated Apr. 25, 2019.

* cited by examiner

PANEL DRIVING ASSEMBLY AND AIR CONDITIONER HAVING THE SAME

TECHNICAL FIELD

The present invention relates to a technical field of air conditioning, and more particularly to a panel driving assembly and an air conditioner having the same.

BACKGROUND

In order to ensure a continuity of a front appearance of an air-conditioning wall-hanging machine, an air-conditioning wall-hanging machine in the prior art usually has a polished panel.

The air-conditioning wall-hanging machine in the prior art has technical defects as follows.

1. A polished panel without a movement mechanism will reduce an area of front air intake, thereby resulting in high heat exchange efficiency loss.

2. A polished panel with a movement mechanism usually has a single movement mode, thereby limiting the panel design; or the movement mechanism is too complex, and a structural reliability is not high accordingly.

SUMMARY

A main objective of the present invention is to provide a panel driving assembly and an air conditioner having the same, intended to solve a problem in the prior art of high heat exchange efficiency loss of an air conditioner.

To this end, according to an aspect of the present invention, a panel driving assembly is provided. The panel driving assembly is used for driving a panel part, and comprises: a first connecting piece, is provided with a first rack, a first end of the first connecting piece is movably connected with the panel part; and a driving part, a first end of the driving part is movably connected with the panel part, a second end of the driving part is engaged with the first rack, and the driving part driving the panel part to be opened or closed.

Further, the driving part comprises: a second connecting piece, one end of the second connecting piece is movably connected with the panel part; and a drive gear, connected with the second connecting piece and engaged with the first rack.

Further, the panel driving assembly further comprises: a transmission gear assembly, provided between the first rack and the drive gear and/or provided between the drive gear and the second connecting piece.

Further, the transmission gear assembly is provided between the first rack and the drive gear, and the transmission gear assembly comprises at least one first transmission gear, the first transmission gear is engaged with the first rack and the drive gear respectively.

Further, the transmission gear assembly is provided between the drive gear and the second connecting piece, and the transmission gear assembly comprises at least one second transmission gear, the second transmission gear is engaged with the drive gear and the second connecting piece respectively.

Further, an ear plate protrudes from an inner wall of the panel part, the ear plate is provided with a sliding groove in an up-down direction, a fixing part protrudes from the first end of the first connecting piece, and the first connecting piece is slidably provided in the sliding groove via the fixing part.

Further, a support bulge is also provided on the inner wall of the panel part, the support bulge is hinged to one end of the second connecting piece.

Further, an ear plate protrudes from an inner wall of the panel part, the ear plate is provided with a sliding groove, and one end of the second connecting piece is slidably provided in the sliding groove.

Further, a support bulge is also provided on the inner wall of the panel part, the support bulge is hinged to the first end of the first connecting piece.

Further, the other end of the second connecting piece has a second rack, the second rack is engaged with the drive gear.

Further, the drive gear is a dual gear, the dual gear comprising: a first gear, engaged with the first rack; and a second gear, coaxially provided with the first gear, the first gear is engaged with the second gear.

Further, the other end of the second connecting piece has an arc-shaped part facing the second gear, the second rack is provided along an edge of the arc-shaped part.

According to another aspect of the present invention, an air conditioner is provided. The air conditioner comprises a panel driving assembly, the panel driving assembly is a panel driving assembly as described above.

By means of the technical solution of the present invention, a panel driving assembly is provided. The panel driving assembly is configured to drive a panel part. The panel driving assembly comprises a first connecting piece and a driving part, wherein the first connecting piece has a first rack, a first end of the first connecting piece is movably connected with the panel part. A first end of the driving part is movably connected with the panel part, a second end of the driving part is engaged with the first rack, and the driving part drives the panel part to be opened or closed. The driving assembly can effectively reduce heat exchange losses. The panel driving assembly has a simple structure and higher reliability.

BRIEF DESCRIPTION OF THE DRAWINGS

The accompanying drawings, which constitute a part of the present application, are used to provide a further understanding of the present invention, and the exemplary embodiments of the present invention and the description thereof are used to explain the present invention, but do not constitute improper limitations to the present invention. In the drawings.

Herein, the above drawings include the following reference signs:

10, panel part; 11, ear plate; 110, sliding groove; 12, support bulge; 20, first connecting piece; 21, first rack; 22, fixing part; 30, driving part; 31, second connecting piece; 310, arc-shaped part; 32, second rack; 33, first gear; 34, second gear.

DETAILED DESCRIPTION OF THE EMBODIMENTS

It should be noted that the embodiments in the present application and the features in the embodiments may be combined with each other without conflicts. The present invention will be described in detail below with reference to the drawings and in conjunction with the embodiments.

Figure 1:
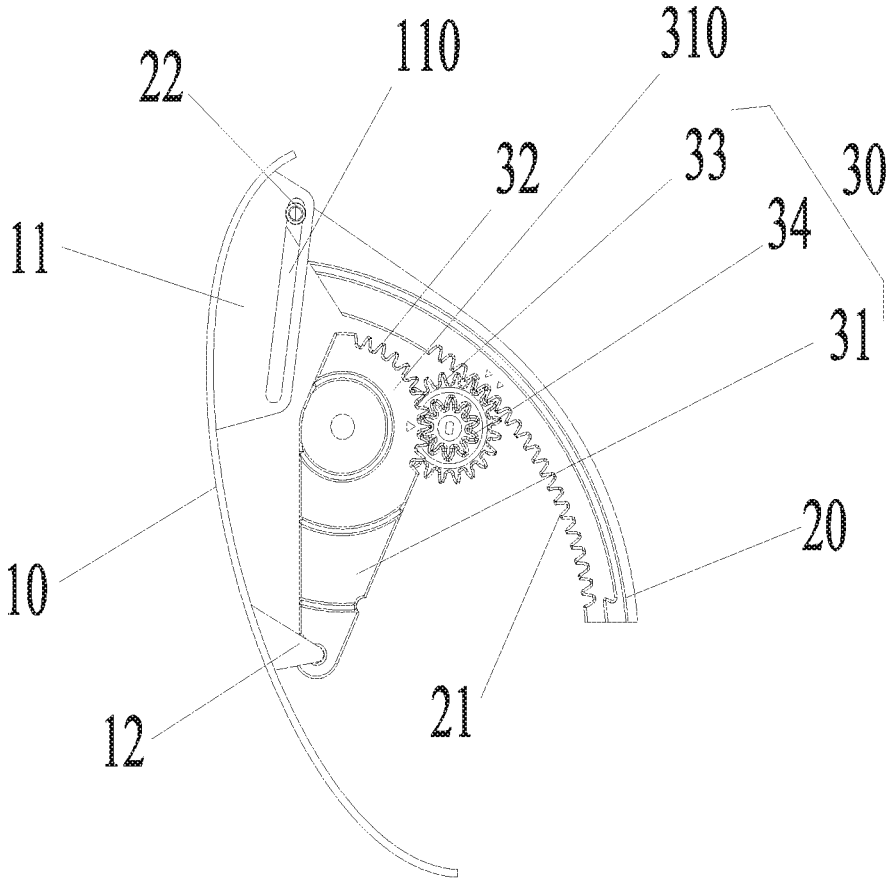
FIG. 1 shows a structural schematic diagram of an embodiment of a panel drive assembly in a closed state according to the present invention.
Figure 2:
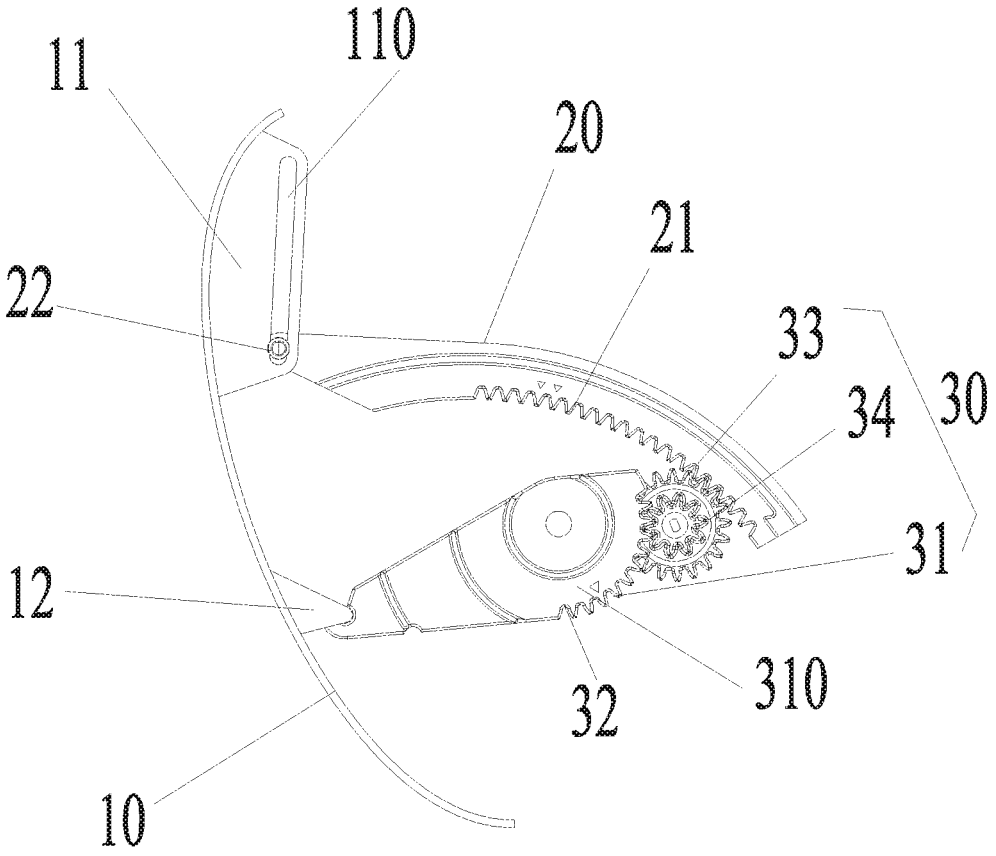
FIG. 2 shows a structural schematic diagram of an embodiment of a panel drive assembly in an opened state according to the present invention.

As shown in FIG. 1 and FIG. 2, according to an embodiment of the present invention, a panel driving assembly is provided. The panel driving assembly is configured to drive a panel part 10. The panel driving assembly comprises a first connecting piece 20 and a driving part 30. The first connecting piece 20 is provided with a first rack 21, a first end of the first connecting piece 20 is movably connected with the panel part 10. A first end of the driving part 30 is movably connected with the panel part 10, a second end of the driving part 30 is engaged with the first rack 21, and the driving part 30 drives the panel part 10 to be opened or closed.

In the present embodiment, a panel driving assembly is provided. The driving assembly is used for driving a panel part. The driving assembly comprises a first connecting piece 20 and a driving part 30, wherein the first connecting piece 20 is provided with a first rack 21, a first end of the first connecting piece 20 is movably connected with the panel part 10. A first end of the driving part 30 is movably connected with the panel part 10, a second end of the driving part 30 is engaged with the first rack 21, and the driving part 30 drives the panel part 10 to be opened or closed. The driving assembly can effectively reduce heat exchange losses. The panel driving assembly has a simple structure and higher reliability. A movement mode of the driving assembly in the present embodiment has a higher adjustability, and is adaptive to various panel designs.

Herein, the driving part 30 comprises a second connecting piece 31 and a drive gear. One end of the second connecting piece 31 is movably connected with the panel part 10. The drive gear is connected with the second connecting piece 31 and engaged with the first rack 21. This arrangement allows the panel driving assembly to have a higher adjustability.

Further, the panel driving assembly further comprises a transmission gear assembly. The transmission gear assembly is provided between the first rack 21 and the drive gear, may also be provided between the drive gear and the second connecting piece 31, or may also be provided between the first rack 21 and the drive gear and provided between the drive gear and the second connecting piece 31 simultaneously. The provision of the transmission gear assembly further enables the panel driving assembly to have a better adjustability and controllability.

In the present embodiment, the transmission gear assembly is provided between the first rack 21 and the drive gear, and the transmission gear assembly comprises at least one first transmission gear, the first transmission gear is engaged with the first rack 21 and the drive gear respectively. This enables the panel driving assembly to have a better adjustability and controllability.

According to a second embodiment of the present invention, the transmission gear assembly is provided between the drive gear and the second connecting piece 31, and the transmission gear assembly comprises at least one second transmission gear, the second transmission gear is engaged with the drive gear and the second connecting piece 31 respectively. This further enables the panel driving assembly to have a better adjustability and controllability.

In the present embodiment, an ear plate 11 protrudes from an inner wall of the panel part 10, the ear plate 11 is provided with a sliding groove 110 in an up-down direction, a fixing part 22 protrudes from the first end of the first connecting piece 20, and the first connecting piece 20 is slidably provided in the sliding groove 110 via the fixing part 22. This arrangement ensures that the first connecting piece 20 does not come off from the panel part 10 during sliding, thereby increasing stability and reliability between the first connecting piece 20 and the panel part 10, wherein the sliding groove 110 may be a linear sliding groove. In the setting direction, the sliding groove 110 may be a vertically-symmetric rectangular sliding groove when the panel is opened. Of course, the sliding groove may also be special-shaped sliding grooves in other forms.

A support bulge 12 is also provided on the inner wall of the panel part 10. The support bulge 12 is hinged to one end of the second connecting piece 31. This arrangement allows the second connecting piece 31 to turn back and forth in a vertical direction, so as to achieve the purpose of driving the panel part 10 to move.

Figure 3:
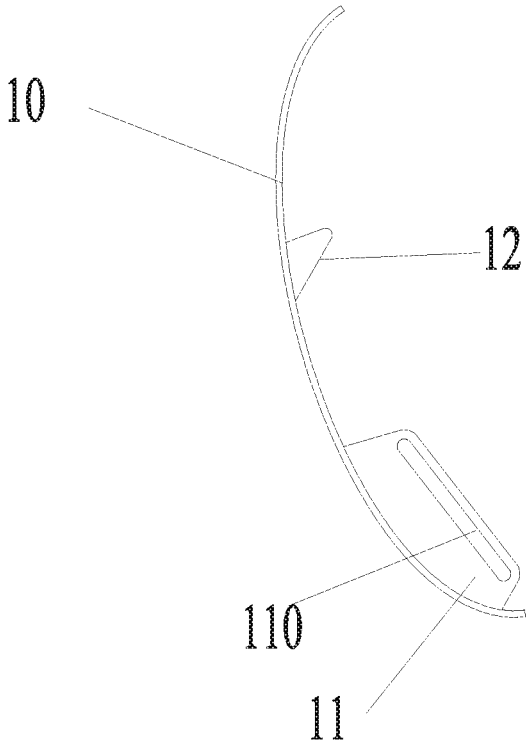
FIG. 3 shows a structural schematic diagram of an embodiment of a panel of a panel drive assembly according to the present invention.

As shown in FIG. 3, according to a third embodiment of the present invention, an ear plate 11 protrudes from an inner wall of the panel part 10, the ear plate 11 is provided with a sliding groove 110, and one end of the second connecting piece 31 is slidably provided in the sliding groove 110. This arrangement ensures that the second connecting piece 31 does not come off from the panel part 10 during sliding, thereby increasing stability and reliability between the second connecting piece 31 and the panel part 10.

Wherein, a support bulge 12 is also provided on the inner wall of the panel part 10, the support bulge 12 is hinged to the first end of the first connecting piece 20. This arrangement allows the first connecting piece 20 to increase connection strength and connection stability between the first connecting piece 20 and the panel part 10.

The other end of the second connecting piece 31 has a second rack 32, the second rack 32 is engaged with the drive gear. This arrangement can increase the adjustability of the panel driving assembly.

In the present embodiment, the drive gear is a dual gear. The dual gear comprises a first gear 33 and a second gear 34. The first gear 33 is engaged with the first rack 21. The second gear 34 is coaxially disposed with the first gear 33, and the first gear is engaged with the second gear 34.

A gear-engagement driving mode further enhances the stability and reliability of the driving assembly, wherein the first gear 33 and the second gear 34 provided coaxially may be set in a form of dual gear, and a controller may also control different motors to respectively control rotation directions of the first gear 33 and the second gear 34 to finally achieve opening and closing functions of the panel part 10. Of course, it is also possible to engage the first gear 33 and the second gear 34 with each other and then to control the rotation directions of the first gear 33 and the second gear 34 to drive opening and closing of the panel part 10.

Wherein, the other end of the second connecting piece 31 has an arc-shaped part 310 facing the second gear 34. The second rack 32 is provided along an edge of the arc-shaped part 310. The arc-shaped portion 310 may effectively solve a problem that the first connecting piece 20 and the panel part 10 have a larger displacement space within a limited space, thereby effectively expanding a rotation range of the first connecting piece 20 or the panel part 10.

Figure 4:
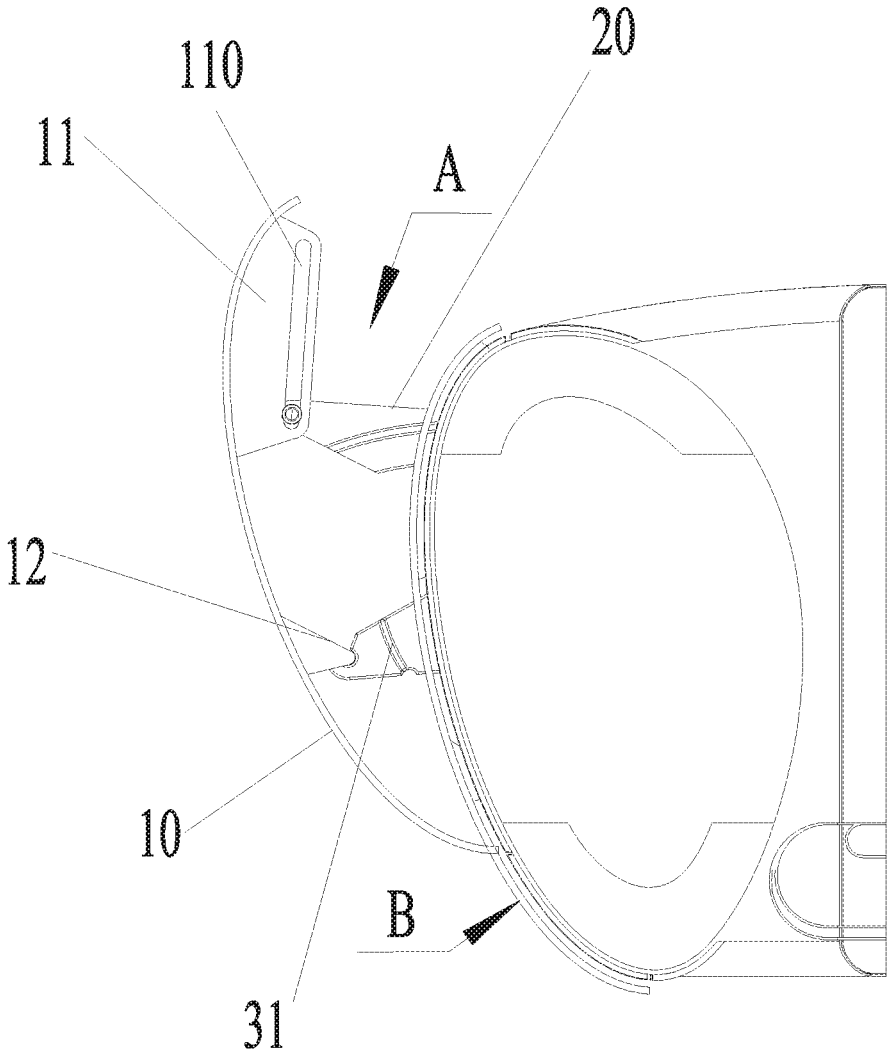
FIG. 4 shows a structural schematic diagram of an embodiment of an air conditioner according to the present invention.

As shown in FIG. 4, the above-mentioned panel driving assembly may be used in air-conditioning panel driving in a technical field of air conditioning. That is, an air conditioner comprises a panel driving assembly that is the panel driving assembly of the above-mentioned embodiment. The air conditioner can ensure the continuity of the front appearance of the air conditioner in a non-working state.

In FIG. 4, when the driving portion 30 drives the first connecting piece 20 and the second connecting piece 31, the drive gear of the driving part 30 is engaged with the first rack 21 on the first connecting piece 20, and drives the first connecting piece 20 to move outward, and the first end of the first connecting piece 20 slides in the sliding groove 110. At the same time, a driven gear is driven by the drive gear to drive the second connecting piece 31 to also move toward an outside of the air conditioner. At this time, openings at an upper end of the panel part 10 and an upper end of the first connecting piece 20 are gradually increased, and a specific enlarged region is as shown at A in FIG. 4, wherein A is an air inlet, and B in the figure is an air outlet. In this way, it is effective to increase the air intake area of the air conditioner in a working state, and this driving mode has a higher adjustability and is adaptive to various panel designs. Throughout the process, the second connecting piece 31 also bears a weight of a panel and performs a lifting action.

From the above description, it can be seen that the above embodiment of the present invention achieves the technical effects as follows.

By means of the technical solution of the present invention, a panel driving assembly is provided. The driving assembly is configured to drive a panel part. The panel driving assembly comprises a first connecting piece and a driving portion, wherein the first connecting piece has a first rack, a first end of the first connecting piece is movably connected with the panel part. A first end of the driving part is movably connected with the panel part, a second end of the driving part is engaged with the first rack, and the driving part drives the panel part to be opened or closed. The driving assembly can effectively reduce heat exchange losses. The panel driving assembly has a simple structure and higher reliability.

The foregoing descriptions are merely preferred embodiments of the present invention and are not intended to limit the present invention. For those skilled in the art, the present invention may have various changes and modifications. Any modification, equivalent replacement and improvement made within the spirit and principle of the present invention shall fall within the protection scope of the present invention.

What is claimed is:

1. A panel driving assembly, for driving a panel part, the panel driving assembly comprising:

a first connecting piece, is provided with a first rack, a first end of the first connecting piece is movably connected with the panel part; and a driving part, a first end of the driving part is movably connected with the panel part, a second end of the driving part is engaged with the first rack, and the driving part driving the panel part to be opened or closed;

the driving part comprises:

a second connecting piece, one end of the second connecting piece is movably connected with the panel part; and a drive gear, connected with the second connecting piece and engaged with the first rack;

wherein the other end of the second connecting piece has a second rack, the second rack is engaged with the drive gear;

the drive gear is a dual gear, the dual gear comprising:

a first gear, engaged with the first rack; and a second gear, coaxially provided with the first gear, the first gear is engaged with the second gear;

the other end of the second connecting piece has an arc-shaped part facing the second gear, the second rack is provided along an edge of the arc-shaped part.

2. The panel driving assembly as claimed in claim 1, further comprising:

a transmission gear assembly, provided between the first rack and the drive gear and/or provided between the drive gear and the second connecting piece.

3. The panel driving assembly as claimed in claim 2, wherein the transmission gear assembly is provided between the drive gear and the second connecting piece, and the transmission gear assembly comprises at least one second transmission gear, the second transmission gear is engaged with the drive gear and the second connecting piece respectively.

4. The panel driving assembly as claimed in claim 1, wherein an ear plate protrudes from an inner wall of the panel part, the ear plate is provided with a sliding groove in an up-down direction, a fixing part protrudes from the first end of the first connecting piece and the first connecting piece is slidably provided in the sliding groove via the fixing part.

5. The panel driving assembly as claimed in claim 4, wherein a support bulge is also provided on the inner wall of the panel part, the support bulge is hinged to one end of the second connecting piece.

6. The panel driving assembly as claimed in claim 1, wherein an ear plate protrudes from an inner wall of the panel part, the ear plate is provided with a sliding groove, and one end of the second connecting piece is slidably provided in the sliding groove.

7. The panel driving assembly as claimed in claim 6, wherein a support bulge is also provided on the inner wall of the panel part, the support bulge is hinged to the first end of the first connecting piece.

8. An air conditioner, comprising a panel driving assembly, the panel driving assembly is a panel driving assembly as claimed in claim 1.

9. The air conditioner as claimed in claim 8, further comprising:

a transmission gear assembly, provided between the first rack and the drive gear and/or provided between the drive gear and the second connecting piece.

10. The air conditioner as claimed in claim 9, wherein a transmission gear assembly is provided between the drive gear and the second connecting piece, and the transmission gear assembly comprises at least one second transmission gear, the second transmission gear is engaged with the drive gear and the second connecting piece respectively.

11. The air conditioner as claimed in claim 8, wherein an ear plate protrudes from an inner wall of the panel part, the ear plate is provided with a sliding groove in an up-down direction, a fixing part protrudes from the first end of the first connecting piece, and the first connecting piece is slidably provided in the sliding groove via the fixing part.

12. The air conditioner as claimed in claim 11, wherein a support bulge is also provided on the inner wall of the panel part, the support bulge is hinged to one end of the second connecting piece.

13. The air conditioner as claimed in claim 8, wherein an ear plate protrudes from an inner wall of the panel part, the ear plate is provided with a sliding groove, and one end of the second connecting piece is slidably provided in the sliding groove.

* * * * *